US009982942B2

(12) United States Patent
Fisher

(10) Patent No.: US 9,982,942 B2
(45) Date of Patent: May 29, 2018

(54) DRYER WITH UNIVERSAL VOLTAGE CONTROLLER

(71) Applicant: World Dryer Corporation, Berkeley, IL (US)

(72) Inventor: David Boyd Fisher, Crystal Lake, IL (US)

(73) Assignee: World Dryer Corporation, Berkeley, IL (US)

( * ) Notice: Subject to any disclaimer, the term of this patent is extended or adjusted under 35 U.S.C. 154(b) by 576 days.

(21) Appl. No.: 14/614,003

(22) Filed: Feb. 4, 2015

(65) Prior Publication Data

US 2015/0226483 A1 Aug. 13, 2015

Related U.S. Application Data

(60) Provisional application No. 61/937,842, filed on Feb. 10, 2014.

(51) Int. Cl.

| | |
|---|---|
| ***A61H 33/08*** | (2006.01) |
| ***F26B 23/06*** | (2006.01) |
| ***H05B 1/02*** | (2006.01) |

(52) U.S. Cl.

CPC ..... *F26B 23/06* (2013.01); *H05B 1/0244* (2013.01)

(58) Field of Classification Search

None

See application file for complete search history.

(56) References Cited

U.S. PATENT DOCUMENTS

| | | | | |
|---|---|---|---|---|
| 4,694,238 | A * | 9/1987 | Norton | H02J 7/1438 322/28 |
| 4,700,049 | A * | 10/1987 | Rubin | A45D 20/16 219/472 |
| 5,200,684 | A | 4/1993 | Fisher | |
| 5,924,148 | A | 7/1999 | Flowers, Sr. | |
| 6,295,410 | B1 | 9/2001 | Helms et al. | |
| 7,148,454 | B2 * | 12/2006 | Chodacki | F23Q 7/24 219/263 |
| 7,362,599 | B2 * | 4/2008 | Rapeanu | H02M 7/066 363/89 |
| 7,663,426 | B2 * | 2/2010 | Fong | G11C 5/14 327/408 |
| 8,296,875 | B2 | 10/2012 | Loberger et al. | |
| 8,508,165 | B2 | 8/2013 | Shinomoto et al. | |
| 8,644,692 | B2 * | 2/2014 | Bedingfield | A61M 5/445 361/160 |
| 2006/0119416 | A1 * | 6/2006 | Fung | G11C 5/14 327/530 |
| 2006/0126368 | A1 * | 6/2006 | Rapeanu | H02M 7/066 363/89 |

(Continued)

FOREIGN PATENT DOCUMENTS

| | | |
|---|---|---|
| CN | 2446939 | 9/2001 |
| CN | 201861539 | 6/2011 |

(Continued)

*Primary Examiner* — Thor Campbell

(74) *Attorney, Agent, or Firm* — Quarles & Brady LLP

(57) ABSTRACT

A hand dryer comprising a universal brushed AC blower vacuum motor, one or more resistive circuits of a heating element, and a universal voltage controller that selectively alternates the configuration and the electrical connection of the resistive circuits, in response to a detected input voltage is disclosed.

20 Claims, 6 Drawing Sheets

(56) References Cited

U.S. PATENT DOCUMENTS

| | | | | |
|---|---|---|---|---|
| 2006/0237434 | A1* | 10/2006 | Sterling | H05B 3/68 219/462.1 |
| 2007/0119069 | A1 | 5/2007 | Shim | |
| 2008/0004963 | A1 | 1/2008 | Montalbano et al. | |
| 2010/0108658 | A1* | 5/2010 | Chodacki | F23Q 7/24 219/262 |
| 2010/0209080 | A1 | 8/2010 | Rubin et al. | |
| 2012/0324755 | A1 | 12/2012 | Zhao | |
| 2013/0095745 | A1 | 4/2013 | Davledzarov | |

FOREIGN PATENT DOCUMENTS

| | | | | |
|---|---|---|---|---|
| EP | 1527709 | | | 3/2008 |
| JP | 64-29206 | A | * | 1/1989 |
| JP | 64-54687 | A | * | 3/1989 |
| JP | 02274202 | A | * | 11/1990 |
| JP | 07236513 | A | * | 9/1995 |
| WO | WO-2013142224 | | | 9/2013 |
| WO | WO-2013149285 | | | 10/2013 |

* cited by examiner

| | Relay Activation Condition | | |
|---|---|---|---|
| Power Supply Input Voltage | 201 | 202 | 203 |
| 120VAC Nominal | ON | OFF | OFF |
| 208VAC Nominal | OFF | ON | ON |
| 240VAC Nominal | OFF | OFF | ON |

Fig. 3

DRYER WITH UNIVERSAL VOLTAGE CONTROLLER

CROSS-REFERENCE TO RELATED APPLICATIONS

This application is a non-provisional of and claims priority to U.S. Patent Application Ser. No. 61/937,842, filed Feb. 10, 2014, and entitled Dryer with universal Voltage Controller, the entirety of which is incorporated herein by reference.

BACKGROUND OF THE INVENTION

The subject matter disclosed herein relates to hand dryers, and in particular, to a hand dryer that automatically adapts to different input voltages.

Universal brushed AC blower vacuum motors are commonly used in hand dryers because their widespread use in other applications, such as floor care equipment, provides availability and lower costs due to economies of scale. High speed or fast drying hand dryers will typically use universal brushed AC blower vacuum motors due to the desirable pressure and flow characteristics of these blowers and their effectiveness in drying hands with shortened dry times. Universal brushed AC blower vacuum motors used in hand dryers range in size from 500-1200 watts input power.

High speed or fast drying hand dryers will typically include a heating element for user comfort that heats air during a drying cycle. Heating elements for hand dryers are typically produced as nichrome wire coils or ribbon wound around a heat-resistant support form. The heating elements are a purely resistive electrical load and typically are typically sized between 400-1900 watts for a hand dryer.

Typical electric circuitry in hand dryer controls will separate the control circuits for a blower vacuum motor and heating element into individual parallel control circuits. In this manner, the control of the blower vacuum motor is not dependent on the operation of the heating element. If the heating element were to fail and cease function, its operation or lack of operation does not impact the function or operation of the blower vacuum motor.

Hand dryer customers desire long, uninterrupted service life with low maintenance, so extended motor brush service life is a desired feature especially in washrooms with high user traffic. Hand dryer customers desire more energy efficient hand dryers as they become more aware of the need for energy conservation and the capacity and efficient management of electrical utility distribution networks.

Universal voltage controllers are becoming a more popular feature of hand dryers since they provide customers the flexibility of installing a single hand dryer model over a range of supply voltages from 120-277 VAC. Typical nominal supply voltages would be 120, 208, 240 or 277 VAC. The universal voltage controllers used in current state of the art hand dryers that incorporate brushed AC blower vacuum motors typically use a technique involving a semiconductor switching device, such as a triac, to manipulate the input voltage supply waveform to regulate the input voltage to the motor and/or heating element, thereby permitting the operation of the hand dryer over a range of input supply voltages from 120-277 VAC. The universal voltage controller includes a means for detecting the input voltage while software in the universal voltage controller defines how the waveform is manipulated depending on the specific ranges of input voltage. A typical hand dryer incorporating a universal brushed AC blower vacuum motor, heating element, and universal voltage controller may have a motor designed and manufactured to operate at a single optimum motor input voltage such as 120 VAC. When supplied with a voltage other than the motor's designed input voltage, the universal controller's embedded software controls the semiconductor switching device to manipulate the waveform of the input voltage to adjust the nominal voltage supplied to the motor and/or heating element. In this case, the input power supply's waveform is changed from the normally expected AC sine waveform to an alternative waveform resulting in the nominal voltage of the waveform being adjusted to a voltage compatible with the motor's design. While this is a common approach used for universal voltage controllers for hand dryers, there are inherent drawbacks.

With the typical approach to universal voltage control used in hand dryers described above, the manipulated waveform can be significantly changed from a normally expected AC sine wave. The resulting changes in the current waveform supplied to the universal brushed AC blower vacuum motor can significantly affect the operating characteristics of the motor's carbon brushes and result in a brush life reduction of 25-50% or greater, as compared with using the normally expected AC sine wave. The resulting shortened motor brush life conflicts with the customer's desire for long, uninterrupted service life.

Another drawback of the described traditional method of universal voltage control for hand dryers is the negative impact on the hand dryer's operational power factor when the normally expected AC sine wave is manipulated to adjust the voltage to the motor. Power factor is a measure of how efficiently electrical power is consumed and is defined as the ratio of real power to apparent power. A purely resistive electrical load is 100% efficient in consuming electrical power and has a power factor of 1. An electrical load that is a combination of resistive and inductive load is less efficient in consuming electrical power and has a power factor less than 1. The lower the power factor of an electrical load, the less efficient it is in consuming electrical power. Power factors less than 1 impact total power consumption, power availability from the power supply, electrical losses in transformer and distribution equipment, and electricity bills. In some examples of hand dryers incorporating universal voltage controllers using the typical approach described above, the power factor of the hand dryer can be reduced to a power factor 0.6 or lower when operating at supply voltages that are different than the design voltage of the motor.

Another drawback of the described traditional method of universal voltage control for hand dryers is sensitivity of the control function to the frequency of the input power supply. In the traditional method for universal voltage control, the software defines how the input waveform is manipulated in response to a specific input voltage and is typically dependent on the frequency of the power supply. The traditional method of manipulating the waveform is dependent on the duration of a half cycle of the alternating waveform. A 60 Hz power supply has a half cycle duration of 8.3 milliseconds (ms), while a 50 Hz power supply has a half cycle duration of 10.0 ms. A traditional universal voltage control for hand dryers designed for 60 Hz operation will develop different motor input voltage and operating characteristics when supplied with a 50 Hz power supply. Multiple control systems typically are developed to address different power supply frequencies.

BRIEF DESCRIPTION OF THE INVENTION

A hand dryer comprising a universal brushed AC blower vacuum motor, one or more resistive circuits of a heating element, and a universal voltage controller that selectively alternates the configuration and the electrical connection of the resistive circuits, in response to a detected input voltage is disclosed. Advantages that may be realized in the practice of some disclosed embodiments of the presently disclosed voltage controller are increased brush life, improved power factor and efficiency, and a simplified control system.

In a first embodiment, a hand dryer configured to accept multiple voltage inputs is provided. The hand dryer comprises a blower vacuum motor for producing output air, a heating element for heating the output air, the heating element comprising a plurality of resistors, a voltage controller for selecting a nominal voltage supplied to the blower vacuum motor, the voltage controller selecting the nominal voltage based on an input voltage by operation of one or more relays to independently select a resistive circuit to be in series or in parallel with the blower vacuum motor.

In a second embodiment, a hand dryer configured to accept multiple voltage inputs is provided. The hand dryer comprises a blower vacuum motor for producing output air, a heating element for heating the output air, the heating element comprising a first resistor and a second resistor, a voltage controller for selecting a nominal voltage supplied to the blower vacuum motor, the voltage controller selecting the nominal voltage based on an input voltage by operation of one or more relays to select a first resistive circuit, a second resistive circuit, or a third resistive circuit, the first resistive circuit has the first resistor and the second resistor in series with each other and in parallel with the blower vacuum motor, the second resistive circuit has the first resistor in series with the blower vacuum motor and the second resistor is not in series with the blower vacuum motor, and the third resistive circuit has the first resistor and the second resistor in series with the blower vacuum motor.

In a third embodiment, a hand dryer is provided. The hand dryer comprises a blower vacuum motor for producing output air, the blower vacuum motor having a dynamic resistance, a heating element for heating the output air, the heating element comprising a first resistor and a second resistor, a voltage controller for selecting a nominal voltage supplied to the blower vacuum motor, the voltage controller selecting the nominal voltage based on an input voltage by operation of one or more relays to select a first resistive circuit, a second resistive circuit or a third resistive circuit, the first resistive circuit has the first resistor and the second resistor in series with each other and in parallel with the blower vacuum motor, the second resistive circuit has the first resistor in series with the blower vacuum motor and the second resistor is not in series with the blower vacuum motor and the second resistive circuit has about a 0.7:1 resistance ratio with the dynamic resistance of the blower vacuum motor, and the third resistive circuit has the first resistor and the second resistor in series with the blower vacuum motor and the third resistive circuit has about a 1:1 resistance ratio with the dynamic resistance of the blower vacuum motor.

This brief description of the invention is intended only to provide a brief overview of subject matter disclosed herein according to one or more illustrative embodiments, and does not serve as a guide to define or limit the scope of the invention. This brief description is provided to introduce an illustrative selection of concepts in a simplified form that are further described below in the detailed description. This brief description is not intended to identify key features or essential features of the invention, nor is it intended to be used as an aid in determining the scope of the invention.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which:

FIG. 3 illustrates an exemplary table of relay activation conditions corresponding to different input voltages;

DETAILED DESCRIPTION OF THE INVENTION

Figure 1:
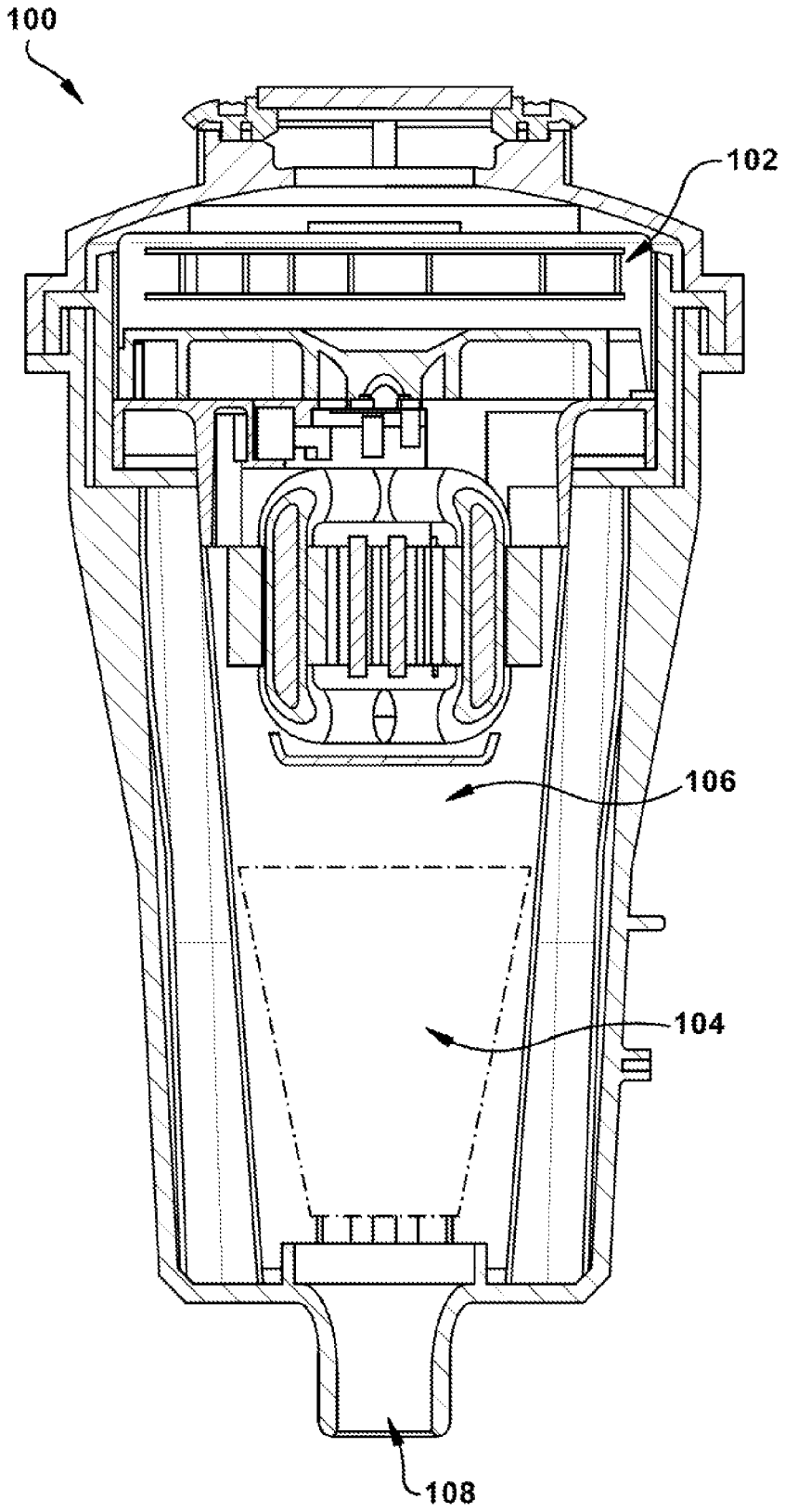
FIG. 1 illustrates a cross section of an exemplary hand dryer for use with embodiments disclosed herein.

FIG. 1 discloses a hand dryer 100 incorporating a universal brushed AC blower vacuum motor 102, a heating element 104 comprising one or more resistive circuits for heating the output air and a universal voltage controller 200 (see FIG. 2) that selects the nominal voltage supplied to the blower vacuum motor 102 through switching relay(s). The relay(s) select resistors of the resistive circuits to be electrically connected in series or parallel with the blower vacuum motor 102. The heating element 104 is disposed between a pressure-side 106 of the blower vacuum motor 102 and a hand dryer outlet 108 for the drying air as shown in FIG. 1.

In one embodiment, the universal brushed AC blower vacuum motor 102 is designed and manufactured for a nominal input supply voltage of 120 VAC with an input power ranging from 500-1200 watts. The one or more resistive circuits of the heating element 104 are sized in electrical resistance to develop a specific ratio with the dynamic resistance of the blower vacuum motor 102. In one embodiment, one resistive circuit of the heating element 104 is sized to create a 1:1 ratio with the dynamic resistance of the blower vacuum motor 102. In one embodiment, a second resistive circuit of the heating element 104 is sized to create a ratio of 0.733 with the dynamic resistance of the blower vacuum motor 102. Another resistive circuit places the resistors in parallel with the blower vacuum motor 102.

Figure 2:
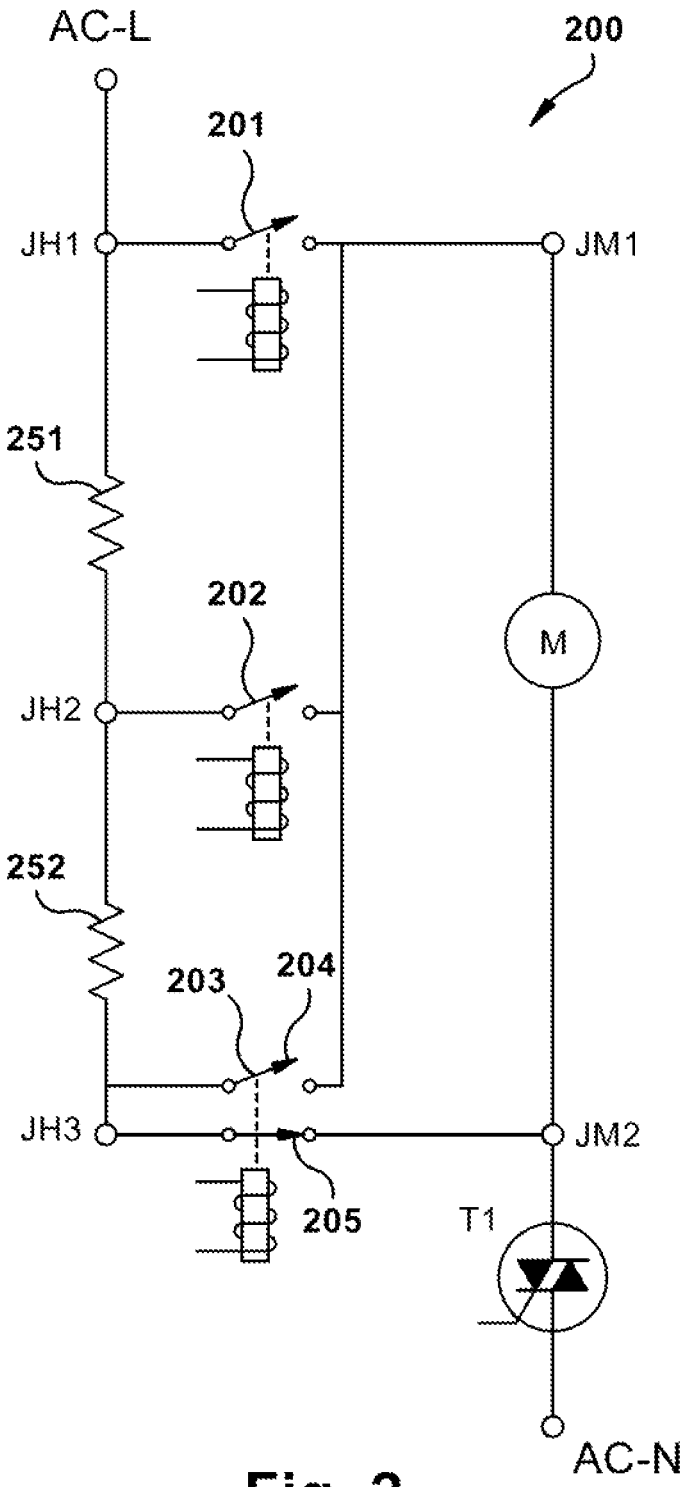
FIG. 2 illustrates a portion of an exemplary universal voltage controller.

As shown in FIG. 2, the universal controller 200 includes a switch, such as a simple electro-mechanical relay or other acceptable switching device, to control the switching of the relay(s) for the one or more resistive circuits to connect resistors in parallel or in series with the blower vacuum motor 102. In some embodiments, the universal voltage controller 200 detects the input voltage using embedded software for controlling the switch. The embedded software may be controlled by a processor.

In the embodiment where a universal brushed AC blower vacuum motor 102 is designed for an input voltage of 120 VAC, a resistive circuit of the heating element 104 with a 1:1 ratio of resistance to the dynamic resistance of the blower vacuum motor 102 is employed. The resistive circuit is configured to be in parallel with the blower vacuum motor 102 when the input voltage is 120 VAC. When the input voltage is 240 VAC, the universal voltage controller 200 will detect the input voltage and the embedded software will cause the resistive circuit of the heating element 104 to be in electrical series with the blower vacuum motor 102. In this instance, the voltage potential across the resistive circuit of the heating element 104 will be half of the input supply voltage and the voltage supplied to the blower vacuum motor 102 will be half of the input voltage (e.g. 120 VAC nominal). When connected electrically in series with the blower vacuum motor 102, the resistive circuit of the heating element 104 provides heat energy for warming the output air for user comfort and adjusts the input voltage supplied to the blower vacuum motor 102. When connected electrically in parallel with the blower vacuum motor 102, the resistive circuit of the heating element 104 will only function to warm the output air for user comfort.

In one embodiment, the heating element 104 has two resistive circuits—a first resistive circuit with a 1:1 ratio of resistance to the dynamic resistance of the blower vacuum motor and a second resistive circuit with a ratio of 0.733 with the dynamic resistance of the blower vacuum motor. In this embodiment, when the input power supply is 120 VAC, the universal controller will detect the input voltage and the embedded software will cause resistors of the resistive circuit to be electrically connected in parallel with the control circuit of the blower vacuum motor 102. When the input voltage is 240 VAC, the universal voltage controller 200 will detect the input voltage and the embedded software will cause the resistors of the resistive circuit of the resistive circuit of the heating element 104 to be in electrical series with the blower vacuum motor 102. When the input voltage is 208 VAC, the universal voltage controller 200 will detect the input voltage and the embedded software will cause select resistor(s) of the resistive circuit of the heating element 104 to be in electrical series with the blower vacuum motor 102. In this manner, the voltage supplied to the blower vacuum motor 102 will be controlled to a nominal 120 VAC when the input power supply is 120, 208 or 240 VAC.

For a specific power supply voltage and motor design voltage, the design ratio of the resistance of the resistive circuit(s) of the heating element 104 to the dynamic resistance of the motor 102 can be calculated as follows:

$$\frac{RE + RM}{2RM} = \frac{VS}{2VM} \tag{1}$$

$$RE + RM = \frac{RM \times VS}{VM} \tag{2}$$

$$RE = \frac{RM \times Vs}{VM} - RM \tag{3}$$

-continued $$RE = RM \times \left(\frac{VS}{VM} - 1\right) \tag{4}$$

In the equations above, RE=resistance of heating element resistive circuit, RM=dynamic resistance of the blower vacuum motor, VS=power supply input voltage, and VM=voltage to be supplied to the blower vacuum motor.

In practice, for an example of a 208 VAC power supply, a blower vacuum motor 102 with a dynamic resistance of 27.5 ohms designed to be supplied at 120 VAC, solving the equations results in RE=20.1 ohms where (VS/VM)−1 is 0.7333. Nominal North American power supply voltages vary from 120-277 VAC. For blower vacuum motors designed for 120 VAC input, the practical ratios that can be used, the ratio of the resistances of the heating element resistive circuits to the dynamic resistance of the blower vacuum motor are shown in the table below.

| | | | |
|---|---|---|---|
| Nominal Supply Voltage (VAC) | 208 | 240 | 277 |
| Motor Design Voltage (VAC) | 120 | 120 | 120 |
| $\frac{\text{resistance of heating element circuit}}{\text{dynamic resistance of motor}}$ | 0.733 | 1.000 | 1.308 |

As mentioned previously, typical blower vacuum motors used in hand dryers are sized from 500-1200 watts. Blower vacuum motors ranging in size from 500-1200 watts and having a design voltage of 120 VAC have dynamic resistances ranging from 12-29 ohms.

Figure 4:
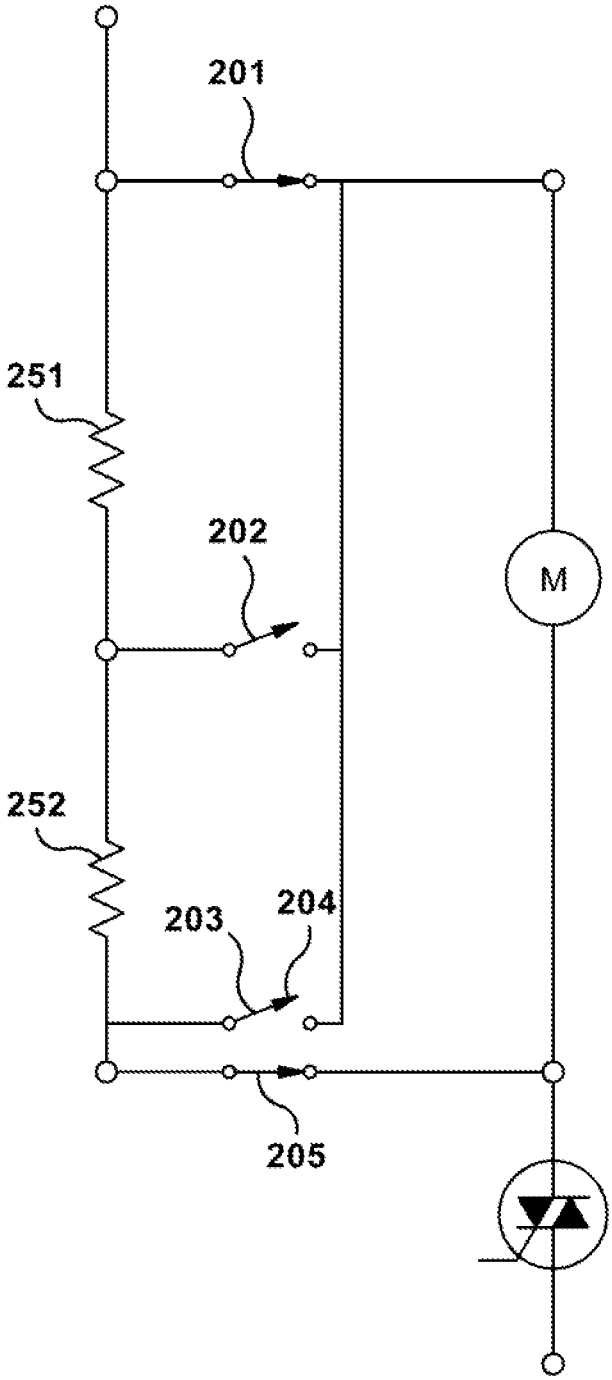
FIG. 4 illustrates a universal voltage controller in a first resistive circuit with two heating elements in series with each other and in parallel with a motor.
Figure 5:
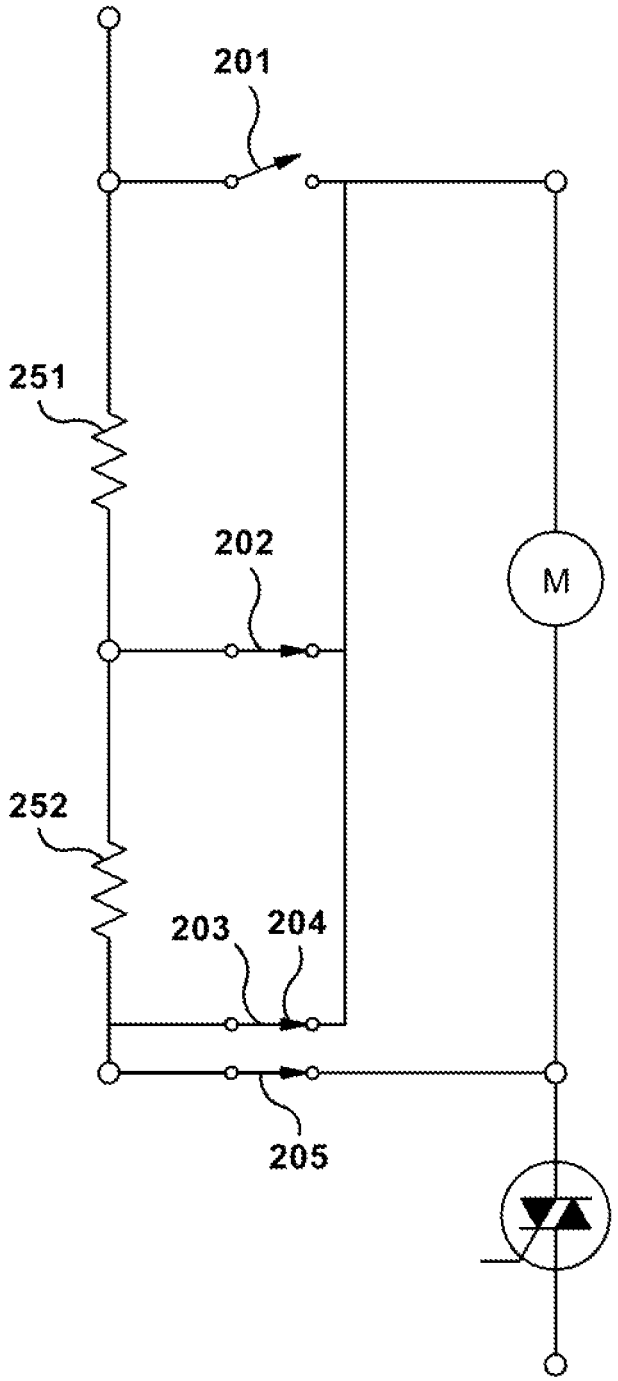
FIG. 5 illustrates a universal voltage controller in a second resistive circuit with one resistive circuit in series with the motor.
Figure 6:
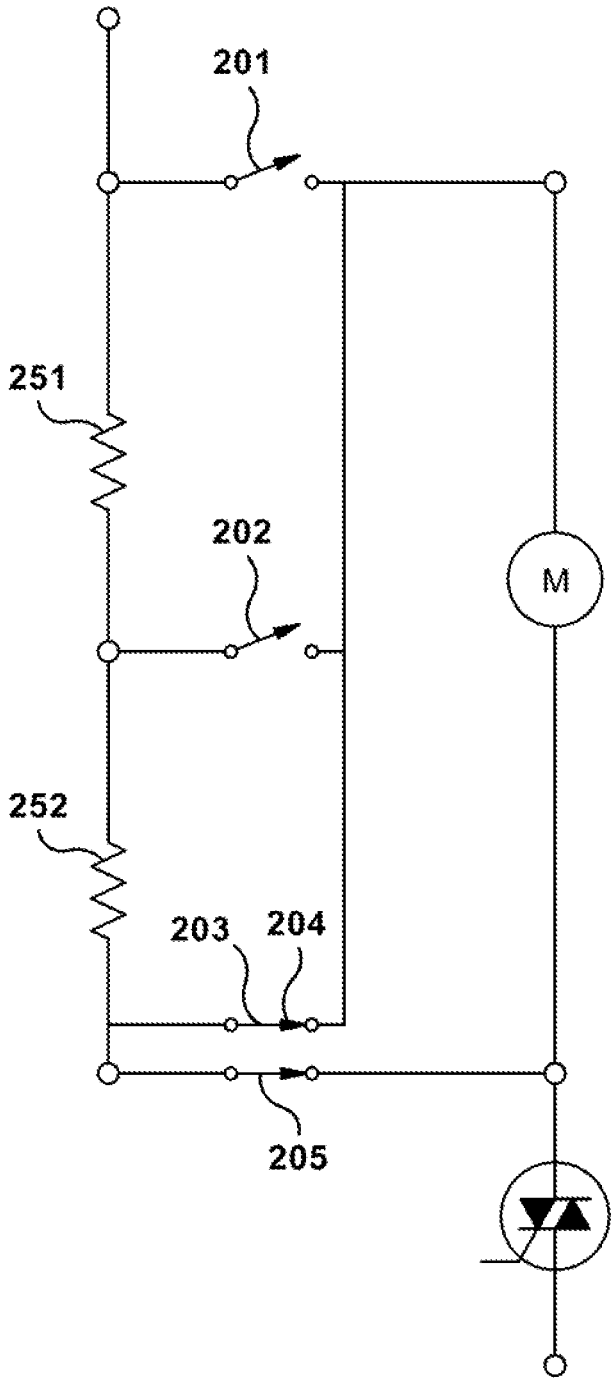
FIG. 6 illustrates a universal voltage controller in a third resistive circuit with two resistive circuits in series with the motor.

FIG. 2 shows the schematic layout of an electrical circuit incorporating a blower vacuum motor (M), a heating element comprising two resistors (251 and 252), and three relays (201, 202 and 203) for controlling the position of the two resistive circuits of the heating element in series or parallel connection with the blower vacuum motor. A triac (T1) is used to switch the circuit on/off as desired. The schematic of FIG. 2 depicts the default contact position (open or closed) of the three relays. The relay 201 and the relay 202 have a default open (OFF) contact condition. While the relay 203 has a set of two contacts in parallel—a first contact 204 defaulting to open (OFF) and the second contact 205 default to closed (ON). Embedded software in the universal voltage controller 200 activates the relays as required to control the position of the two resistors (251 and 252) of the heating element in series or parallel connection with the blower vacuum motor (M). FIG. 3 indicates the activation condition ("ON" or "OFF") of relays 201, 202 and 203 at various power supply voltages. These resistive circuits are depicted in FIGS. 4-6. Unlike semiconductor approaches that adjust the waveform, the disclosed universal voltage controller 200 maintains the same waveform. This results in an increased life of the motor.

The resistive circuit depicted in FIG. 4 is suitable at a first input voltage. For example, at 120 VAC input, the relay 201 is in an "ON" state while the relay 202 and the relay 203 are left in an "OFF" state. The resistor 251 and the resistor 252 of the heating element are in series with each other and in parallel with motor M.

The resistive circuit depicted in FIG. 5 is suitable at a second input voltage that is greater than the first input voltage. For example, at 208 VAC input, the relay 202 and the relay 203 are in an "ON" state and the relay 201 is in an "OFF" state. In this resistive circuit at 208 VAC, the resistor 251 is in series with the motor M. The resistor 252 is not in series with the motor M.

The resistive circuit depicted in FIG. 6 is suitable at a third input voltage that is greater than both the first input voltage and the second input voltage. For example, at 240 VAC input, the relay 203 is in an "ON" state while the relay 201 and the relay 202 are in an "OFF" state. In this resistive circuit at 240 VAC, both the resistor 251 and the resistor 252 are in series with the motor M.

In one practical example, the blower vacuum motor has a dynamic resistance of 27.5 ohms and the resistor 251 and the resistor 252 have design resistances of 20.15 ohms and 7.35 ohms, respectively. At 240 VAC input, the sum of resistances of the resistor 251 and the resistor 252 provides a 1:1 ratio with the dynamic resistance of the motor. At 208 VAC input, the resistor 251 is in series connection with the motor and has a resistance that develops a ratio of about 0.7 (e.g. 0.733) with the dynamic resistance of the motor.

General manufacturing tolerances for a blower vacuum motor will result in a practical tolerance of +/−10% for the dynamic resistance of the population of blower vacuum motors. Resistive heating elements will have a practical tolerance up to +/−1 ohm resistance. It is understood that the realized ratios between the resistance of the resistive circuit(s) of the heating element and the dynamic resistance of the motor will vary according to these practical limits of tolerances, and maintain the general relationship of the design ratios and result in the desired control of the voltage supplied to the blower vacuum motor in an acceptable way.

It is understood that general tolerance on the input voltage provided by utility companies is typically+6%/−13% from nominal voltage. The intent of the disclosed embodiments is not to ensure a particular blower vacuum motor will always be supplied with a specific nominal voltage, but rather the voltage supplied to the blower vacuum motor will be controlled within the same range of voltages that would normally be encountered with a dedicated voltage hand dryer.

It is further understood that the embodiments disclosed herein do not limit the scope of the claims below. Additional embodiments involving more than two resistive heating element circuits and having varying ratios with the dynamic resistance of the blower vacuum motor can be developed in coordination with a universal voltage controller that would control the resistive circuits in either parallel or series electrically with the control circuit of the blower vacuum motor in order to adjust and control the voltage supplied to the blower vacuum motor. Additional separate resistive circuits of a heating element can be developed to expand the range of input power supply voltages to include 120, 208, 220, 240 and 277 VAC voltages.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A hand dryer configured to accept multiple voltage inputs, the hand dryer comprising:

a blower vacuum motor for producing output air;

a heating element for heating the output air, the heating element comprising a plurality of resistors configured to form a plurality of resistive circuits, each of the plurality of resistive circuits in one of series and parallel with the blower vacuum motor; and a voltage controller for selecting a nominal voltage supplied to the blower vacuum motor via the plurality of resistors of the heating element, the voltage controller selecting the nominal voltage based on an input voltage by operating one or more relays to independently select one of the plurality of resistive circuits.

2. The hand dryer as recited in claim 1, wherein the plurality of resistive circuits comprises a first resistive circuit, a second resistive circuit, and a third resistive circuit, and the plurality of resistors comprises a first resistor and a second resistor.

3. A hand dryer configured to accept multiple voltage inputs, the hand dryer comprising:

a blower vacuum motor for producing output air;

a heating element for heating the output air, the heating element comprising a first resistor and a second resistor;

a voltage controller for selecting a nominal voltage supplied to the blower vacuum motor, the voltage controller selecting the nominal voltage based on an input voltage by operation of one or more relays to select a first resistive circuit, a second resistive circuit, or a third resistive circuit;

the first resistive circuit has the first resistor and the second resistor in series with each other and in parallel with the blower vacuum motor;

the second resistive circuit has the first resistor in series with the blower vacuum motor and the second resistor is not in series with the blower vacuum motor; and the third resistive circuit has the first resistor and the second resistor in series with the blower vacuum motor.

4. The hand dryer as recited in claim 3, wherein the first resistive circuit has a first circuit resistance and the second resistive circuit has a second circuit resistance, the second circuit resistance being greater than the first circuit resistance.

5. The hand dryer as recited in claim 3, wherein the first resistive circuit has a first circuit resistance and the second resistive circuit has a second circuit resistance, the second circuit resistance being at least ten ohms greater than the first circuit resistance.

6. The hand dryer as recited in claim 3, further comprising a switch that selectively actuates the one or more relays to select the first resistive circuit, the second resistive circuit, or the third resistive circuit.

7. The hand dryer as recited in claim 6, further comprising a processor configured to control embedded software that actuates the switch.

8. The hand dryer as recited in claim 6, wherein the one or more relays comprise at least three relays.

9. The hand dryer as recited in claim 3, wherein the input voltage has an alternating current (AC) waveform that is maintained in the first resistive circuit, in the second resistive circuit, and in the third resistive circuit.

10. The hand dryer as recited in claim 3, wherein the second resistive circuit has a second circuit resistance equal to a first resistance of the first resistor.

11. The hand dryer as recited in claim 10, wherein the third resistive circuit has a third circuit resistance equal to a sum of the first resistance of the first resistor and a second resistance of the second resistor.

12. The hand dryer as recited in claim 3, wherein the one or more relays are configured to select a resistive circuit from a group consisting of the first resistive circuit, the second resistive circuit, and the third resistive circuit.

13. The hand dryer as recited in claim 3, wherein the second resistive circuit has a second circuit resistance ($RE_2$) given by:

$$RE_2 = RM \times \left(\frac{VS}{VM} - 1\right)$$

where

RM=a dynamic resistance of the blower vacuum motor;

VS=the input voltage;

VM=the nominal voltage to be supplied to the blower vacuum motor, and $RE_2$ is equal to a first resistance of the first resistor.

14. The hand dryer as recited in claim 13, wherein the third resistive circuit has a third circuit resistance ($RE_3$) given by:

$$RE_3 = RM \times \left(\frac{VS}{VM} - 1\right)$$

where

RM=the dynamic resistance of the blower vacuum motor;

VS=the input voltage;

VM=the nominal voltage to be supplied to the blower vacuum motor, and $RE_3$ is equal to a sum of the first resistance of the first resistor and a second resistance of the second resistor.

15. The hand dryer as recited in claim 14, wherein the input voltage (VS) is selected from the group consisting of 120 VAC, 208 VAC, 240 VAC and 277 VAC.

16. The hand dryer comprising:

a blower vacuum motor for producing output air, the blower vacuum motor having a dynamic resistance;

a heating element for heating the output air, the heating element comprising a first resistor and a second resistor;

a voltage controller for selecting a nominal voltage supplied to the blower vacuum motor, the voltage controller selecting the nominal voltage based on an input voltage by operation of one or more relays to select a first resistive circuit, a second resistive circuit or a third resistive circuit;

the first resistive circuit has the first resistor and the second resistor in series with each other and in parallel with the blower vacuum motor;

the second resistive circuit has the first resistor in series with the blower vacuum motor and the second resistor is not in series with the blower vacuum motor and the second resistive circuit has about a 0.7:1 resistance ration with the dynamic resistance of the blower vacuum motor; and the third resistive circuit has the first resistor and the second resistor in series with the blower vacuum motor and the third resistive circuit has about a 1:1 resistance ratio with the dynamic resistance of the blower vacuum motor.

17. The hand dryer as recited in claim 16, where the second circuit has a second circuit resistance ($RE_2$) given by:

$$RE_2 = RM \times \left(\frac{VS}{VM} - 1\right)$$

where

RM=a dynamic resistance of the blower vacuum motor;

VS=the input voltage;

VM=the nominal voltage to be supplied to the blower vacuum motor, and $RE_2$ is equal to a first resistance of the first resistor.

18. The hand dryer as recited in claim 17, wherein the third resistive circuit has a third circuit resistance ($RE_3$) given by:

$$RE_3 = RM \times \left(\frac{VS}{VM} - 1\right)$$

where

RM=the dynamic resistance of the blower vacuum motor;

VS=the input voltage;

VM=the nominal voltage to be supplied to the blower vacuum motor, and $RE_3$ is equal to a sum of a first resistance of the first resistor and a second resistance of the second resistor.

19. The hand dryer as recited in claim 16, wherein the input voltage is selected from the group consisting of 120 VAC, 208 VAC, 240 VAC and 277 VAC.

20. The hand dryer as recited in claim 16, wherein the nominal voltage to be supplied to the blower vacuum motor is 120 VAC and the input voltage is selected from the group consisting of 208 VAC, 240 VAC and 277 VAC.

* * * * *